US006321566B1

(12) United States Patent
Yamamoto et al.

(10) Patent No.: US 6,321,566 B1
(45) Date of Patent: Nov. 27, 2001

(54) METHOD FOR PRODUCING OXYGEN GAS

(75) Inventors: Seiichi Yamamoto; Kazuhiko Asahara; Masayuki Tanaka, all of Kobe (JP)

(73) Assignee: Kabushiki Kaisha Kobe Seiko Sho., Hyogo (JP)

( * ) Notice: Subject to any disclaimer, the term of this patent is extended or adjusted under 35 U.S.C. 154(b) by 0 days.

(21) Appl. No.: 09/563,165

(22) Filed: May 1, 2000

(30) Foreign Application Priority Data

May 21, 1999 (JP) ..... 11-142030

(51) Int. Cl.[7] ..... F25J 3/00
(52) U.S. Cl. ..... 62/643; 62/654
(58) Field of Search ..... 62/643, 654

(56) References Cited

U.S. PATENT DOCUMENTS

| | | | | |
|---|---|---|---|---|
| 3,086,371 | * | 4/1963 | Schilling et al. | 62/654 |
| 5,355,681 | * | 10/1994 | Xu | 62/654 |
| 5,467,601 | * | 11/1995 | Poalino et al. | 62/654 |
| 5,551,258 | * | 9/1996 | Rathbone | 62/654 |

FOREIGN PATENT DOCUMENTS

| | | |
|---|---|---|
| 576 314 B2 | 6/1993 | (EP) . |
| 694 744 B1 | 7/1995 | (EP) . |

OTHER PUBLICATIONS

Trans. Instn Chem. Engrs., vol. 55, p. 46–52, 1977.
A.I. Ch. E. Journal, vol. 7, No. 2, P 282–287, Jun. 1961.
A.I. Ch. E. Journal, vol. 5, No. 4, P 506–509, Dec. 1959.
Int. Chem, Eng., vol. 18, No. 2, p 223–236, Apr. 1978.
Trans. Instn Chem. Engrs., vol. 32, P. 222–235, 1954.
Int. Chem, Eng., vol. 26, No. 3, p 345–354, May 1980.
Ind. Eng. Chem. Process. Des, Dev., vol. 20, No. 3, p 528–532, 1981.
Chem. Eng. Technol., vol. 10, p. 224–230, 1987.
Chem. Eng. Progress, p. 72–80, Jul. 1995.
A. Mersmann, "Thermische Verfahrenstechnik", Springer Verlag Berlin Heidelberg New York 1980, pp. 157–158.

* cited by examiner

*Primary Examiner*—Ronald Capossela
(74) *Attorney, Agent, or Firm*—Reed Smith Hazel & Thomas LLP

(57) ABSTRACT

Liquid oxygen, which is extracted from the bottom of a lower pressure rectifier and compressed by a liquid oxygen pump to a predetermined supply pressure, is evaporated in a main heat exchanger to prepare an oxygen gas product, while oxygen gas is circulated in the main heat exchanger at a linear velocity which is equal to or higher than the terminal velocity, calculated depending on the supply pressure, of an oxygen droplet having a diameter of 200 $\mu$m. This process effectively prevents precipitation of heavy impurities in the heat exchanger and produces higher pressure oxygen gas at reduced operational costs.

3 Claims, 3 Drawing Sheets

METHOD FOR PRODUCING OXYGEN GAS

BACKGROUND OF THE INVENTION

1. Field of the Invention

The present invention relates to a method for producing oxygen gas which includes compressing liquid oxygen obtained by cryogenic separation and then evaporating the liquid oxygen by heating to prepare higher pressure gaseous oxygen.

2. Description of the Related Art

A large amount of higher pressure gaseous oxygen is used in oxidizing refining steps in steel-producing converters in the steel industry, synthetic steps of ethylene oxide by oxidation of ethylene in the chemical industry, and partial oxidation steps of fuel, such as coal and petroleum residues, in fuel fired power plants. The demand for such oxygen has tended to increase in recent years.

A typical method for producing oxygen on an industrial scale is cryogenic separation, which includes rectification of raw air at low temperatures to separate out oxygen. In the cryogenic separation, nitrogen and oxygen are separated out from raw air by means of a difference in boiling point. That is, liquefied air is supplied to a rectifier, and nitrogen, having higher volatility than that of oxygen, is evaporated in the rectifier to yield a high concentration of liquid oxygen.

In a method for producing higher pressure gaseous oxygen in the cryogenic separation, liquid oxygen extracted from the rectifier is compressed using a pump and is then heated in a heat exchanger to evaporate the liquid oxygen. As an advantage of this method, compression costs can be significantly reduced compared to compression of gaseous oxygen.

Raw air contains trace amounts of impurities, such as hydrocarbons, e.g., methane, ethane, ethylene, acetylene, propane, propylene, butane, butene, and pentane; carbon dioxide; and nitrogen oxides, in addition to major components, such as nitrogen, oxygen, and argon. Since such impurities have higher boiling points than those of nitrogen and oxygen and are less volatile, these are called heavy impurities. These heavy impurities are dissolved in liquid oxygen having lower volatility than that of nitrogen. Since the heavy impurities have higher boiling points and are less volatile compared to oxygen, these are concentrated in the liquid oxygen as evaporation of the liquid oxygen proceeds in the heat exchanger, and is precipitated in an oxygen channel in the heat exchanger as a solid phase or a liquid phase when the concentration exceeds the solubility to liquid oxygen. The precipitated heavy impurities will readily react with oxygen in the heat exchanger and clogs the oxygen channel. As a result, performance of the heat exchanger and thus overall performance of the apparatus will be deteriorated.

The following conventional means are disclosed for solving such problems.

Japanese Unexamined Patent Application Publication No. 7-174460 discloses extraction of a major fraction of liquid oxygen from a liquid phase having a relatively low heavy-impurity concentration at a second-bottom stage right above the lowermost stage in a lower pressure distillation tower. Moreover, a small fraction of liquid oxygen is extracted from the lowermost stage containing the largest amount of impurities. The extracted liquid oxygen is compressed to a pressure, which is equal to or higher than the final supply pressure, to raise the boiling point of oxygen, and is fed into a heat exchanger to raise the vapor pressure of heavy impurities contained in the liquid oxygen. Evaporation of the heavy impurities is thereby facilitated in the heat exchanger and the heavy impurities are not accumulated in the heat exchanger.

Japanese Unexamined Patent Application Publication No. 8-61843 discloses a method including a recycle flow for removing heavy impurities. The recycle flow means the following gas flow. A liquid having an enriched oxygen content of approximately 40% and containing concentrated heavy impurities is extracted from the bottom of a higher pressure rectifier and is sufficiently compressed so that the heavy impurities are evaporated in a heat exchanger. The pressure of the residual air is reduced and then the air is allowed to converge to raw air. The converged air flow is supplied to a preliminary purification unit to remove the heavy impurities.

These methods, however, still have the following problems. In the former method, the liquid oxygen extracted from the second-bottom stage contains a low concentration of heavy impurities. Thus, this method is not a basic countermeasure to precipitation of heavy impurities. When the system is continuously operated for long periods, for example, a year, the heavy impurities will be significantly precipitated in the heat exchanger. Since the system has two oxygen channels, the facility and operational costs are increased due to use of expensive apparatuses, such as liquid oxygen pumps, and a complicated overall processes.

The latter method also requires additional apparatuses such as liquid oxygen pumps for the cycle reflow. Thus, this method requires high facility and operational costs due to a complicated system and a complicated operation. Accordingly, this method is also not a basic countermeasure.

SUMMARY OF THE INVENTION

It is an object of the present invention to provide a method for producing gaseous oxygen by cryogenic separation at low costs which does not cause precipitation of heavy impurities in an oxygen channel of a heat exchanger.

In the production of gaseous oxygen which includes compressing liquid oxygen separated by rectifying raw air to a predetermined pressure and evaporating the liquid oxygen in a heat exchanger, the present inventors have performed experiments under various conditions and have discovered that the above problems are overcome when the linear velocity of the gaseous oxygen in the oxygen channel of the heat exchanger is increased so as to satisfy the following parameters. As a result, the present invention has been completed.

A method for producing gaseous oxygen in accordance with the present invention includes compressing liquid oxygen separated by rectifying raw air to a predetermined supply pressure and evaporating the liquid oxygen in a heat exchanger, wherein gaseous oxygen in an oxygen channel of the heat exchanger flows upwards at a linear velocity which is equal to or larger than the terminal velocity, calculated depending on the supply pressure, of an oxygen droplet having a predetermined diameter.

The method for producing gaseous oxygen from raw air comprises the steps of compressing liquid oxygen separated by rectifying the raw air to a predetermined supply pressure, supplying the compressed liquid oxygen to a heat exchanger under a predetermined supply pressure, and evaporating and gasifying the liquid oxygen in the heat exchanger, wherein the gaseous oxygen flows upwards at a linear velocity which is equal to or higher than the terminal velocity u of a liquid oxygen droplet having a diameter of 200 $\mu$m calculated by equation (1):

$$u = \left( \frac{4g^2(\rho_L - \rho_G)^2 D_p^3}{225\mu\rho_G} \right)^{1/3} \quad (1)$$

wherein u: terminal velocity of liquid oxygen droplets, g: acceleration due to gravity, $\rho_L$: density of saturated liquid oxygen at the supply pressure, $\rho_G$: density of saturated gaseous oxygen at the supply pressure, $\mu$: viscosity of saturated gaseous oxygen at the supply pressure, and $D_P$: diameter of the liquid oxygen droplet.

Equation (1) determines the terminal velocity of a microdroplet which follows Aren's resistance law which covers the range 2<Re<500 where in R is the Reynolds number.

Preferably, the gaseous oxygen flows upwards at a linear velocity which is equal to or higher than the terminal velocity u of a liquid oxygen droplet having a diameter of 500 $\mu$m calculated by equation (2):

$$u = \left( \frac{3.03g(\rho_L - \rho_G)D_P}{\rho_G} \right)^{1/2} \quad (2)$$

wherein u: terminal velocity of liquid oxygen droplets, g: acceleration due to gravity, $\rho_L$: density of saturated liquid oxygen at the supply pressure, $\rho_G$: density of saturated gaseous oxygen at the supply pressure, $\mu$: viscosity of saturated gaseous oxygen at the supply pressure, and $D_P$: diameter of the liquid oxygen droplet.

Equation (2) determines the terminal velocity of a microdroplet which follows Newton's resistance law which covers the range 500<Re<100,000 where Re is the Reynolds number.

More preferably, the gaseous oxygen flows upwards at a linear velocity which is equal to or higher than the terminal velocity u of a liquid oxygen droplet having a diameter of 1 mm calculated by equation (2).

When the gaseous oxygen flows upwards at a linear velocity which is equal to or higher than the terminal velocity of an oxygen droplet having a predetermined diameter in the oxygen channel of the heat exchanger, accumulation and precipitation of heavy impurities are prevented. The reason is presumed to be as follows.

When liquid oxygen is evaporated in the oxygen channel of the heat exchanger, oxygen microdroplets are formed due to irregularities on the surface of the liquid oxygen or the gas-liquid interface. The oxygen microdroplets are considered to contain heavy impurities in a concentration which is substantially the same as the concentration in the liquid oxygen in the heat exchanger. Such microdroplets finally descend at a terminal velocity which is calculated by equation (1) or (2). If peripheral gaseous oxygen ascends at a linear velocity which is equal to or higher than the terminal velocity, these microdroplets will ascend in concordance with the gas flow. The oxygen droplets entrained in the gas flow are evaporated by peripheral heat and thus heavy impurities contained in the oxygen droplets are also completely evaporated.

By entrainment of oxygen droplets into the gas flow, the heavy impurities contained in the oxygen droplets are forcibly evaporated. Such evaporation is significantly efficient compared to migration of heavy impurities from the liquid phase to the gas phase based on the vapor pressures of the heavy impurities.

Since this method and apparatus facilitate evaporation of heavy impurities in the oxygen channel of the heat exchanger, no specific mechanism, such as the above recycle flow, is required for preventing precipitation of heavy impurities. Accordingly, this process prevents concentration of heavy impurities in liquid oxygen and thus precipitation of the heavy impurities in the oxygen channel while suppressing operational costs.

DESCRIPTION OF THE PREFERRED EMBODIMENT

Figure 1:
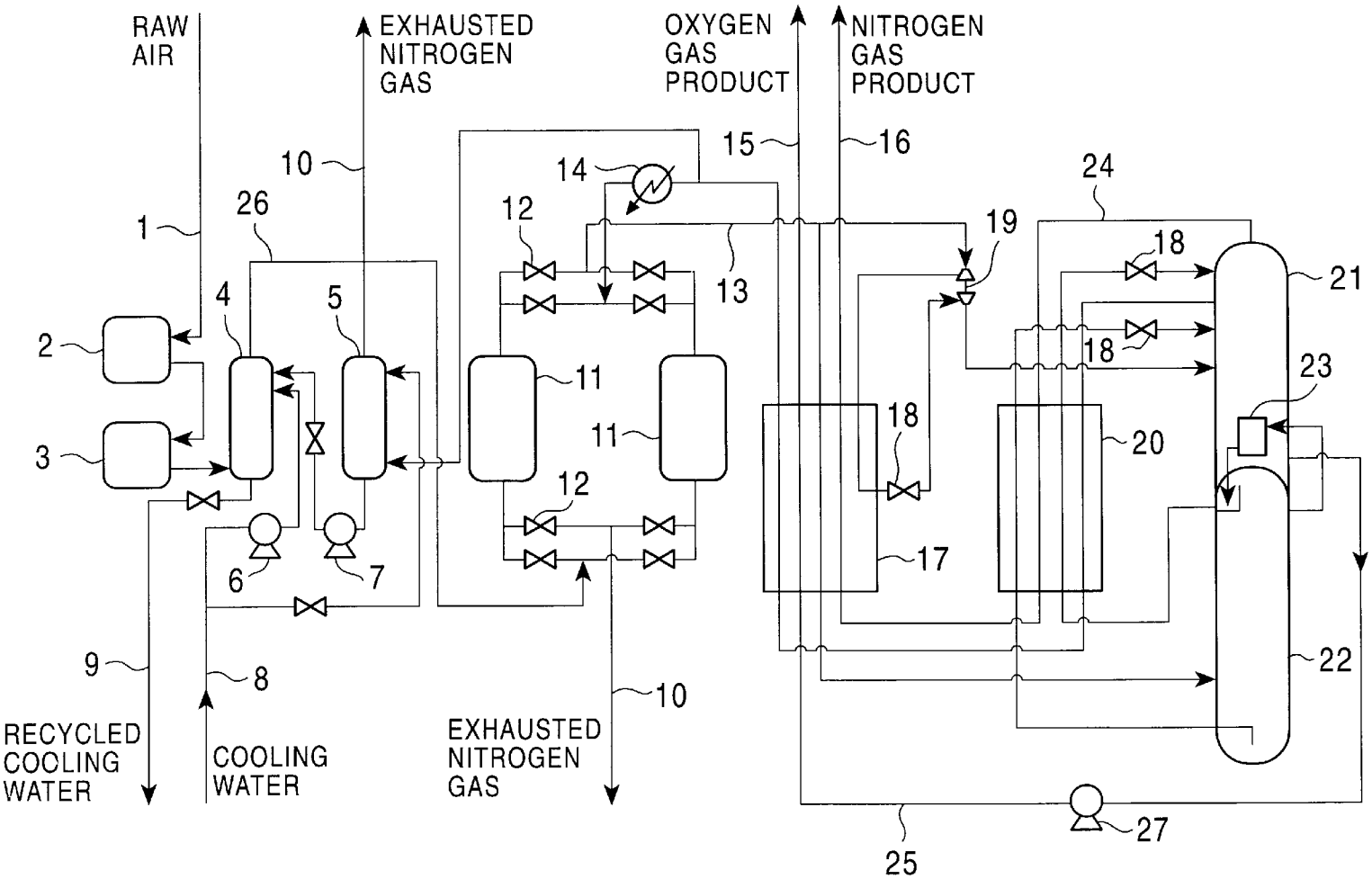
FIG. 1 is a schematic diagram of an apparatus for producing oxygen gas in accordance with the present invention.

FIG. 1 is a schematic diagram of an apparatus (an air separation apparatus) used in the method for producing gaseous oxygen in accordance with the present invention. This apparatus can have various configurations depending on the amount and purity of oxygen produced and depending on whether or not rare gases are recovered.

Raw air fed from a line 1 passes through an air filter 2, which removes rough or coarse dust, is introduced into an air compressor 3, and is compressed therein (compression step).

The compressed air is introduced into a wet cooling tower 4 to remove compression heat by cooling water from a line 8 (cooling step). A part of the cooling water from the line 8 to be fed into the wet cooling tower 4 is supplied to an evaporative cooling tower 5, is cooled by cryogenic nitrogen gas which is separated in a lower pressure rectifier 21, and is then supplied to the wet cooling tower 4 by a cooling-water pump 7. The rest of the cooling water from the line 8 is directly supplied into the wet cooling tower 4 by a water pump 6. The cryogenic nitrogen gas is exhausted from the evaporative cooling tower 5 through a line 10, and the cooling water is exhausted from the wet cooling tower 4 through a line 9.

The raw air cooled in the wet cooling tower 4 is fed into a twin-tower molecular sieve adsorption unit 11 through a line 26 to remove most of the heavy impurities (purification step). In this twin-tower molecular sieve adsorption unit 11, one tower adsorbs heavy impurities in the raw air while the other tower desorbs the adsorbed heavy impurities to be reused. The desorption process is performed by circulating nitrogen gas, which is purified in the lower pressure rectifier 21 and heated by a heater 14. A valve 12 switches the adsorption/desorption of these towers, and the nitrogen gas used in the desorption process is exhausted through a line 10.

The raw air purified in the molecular sieve adsorption unit 11 is led into the lower pressure rectifier 21 and a higher pressure rectifier 22 through a line 13. That is, a fraction of the raw air is fed into a main heat exchanger 17, is liquefied therein and is supplied into the higher pressure rectifier 22, while the other fraction of the raw air is compressed in an expansion turbine 19, is cooled in the main heat exchanger 17, is expanded in the expansion turbine 19, and is supplied into the lower pressure rectifier 21.

The higher pressure rectifier 22 produces high-purity nitrogen gas at the top thereof. The produced nitrogen gas is supplied to a main condenser 23 provided in the lower pressure rectifier 21 and is exothermally liquefied therein. The liquid nitrogen is recycled to the higher pressure rectifier 22. That is, the main condenser 23 also functions as a reboiler of the lower pressure rectifier 21 and permits heat exchange between the higher pressure rectifier 22 and the lower pressure rectifier 21. A fraction of the liquid nitrogen recycled from the main condenser 23 is supplied to a supercooling unit 20, is supercooled therein, and is supplied to the top of the lower pressure rectifier 21 as reflux liquid while reducing the pressure thereof by a pressure-reducing valve 18.

At the bottom of the higher pressure rectifier 22, an oxygen concentrated air is obtained, is extracted from the higher pressure rectifier 22, is supercooled in the supercooling unit 20, and is supplied to the lower pressure rectifier 21 while reducing the pressure thereof by another pressure-reducing valve 18.

The lower pressure rectifier 21 rectifies the air. At the top of the lower pressure rectifier 21, high-purity nitrogen gas as a final product is produced. The high-purity nitrogen gas is extracted from the top of the lower pressure rectifier 21, and is introduced to the supercooling unit 20 through a line 24. The gas is warmed in the supercooling unit 20 and the main heat exchanger 17, and is exhausted from a line 16 as the final nitrogen gas product.

Exhausted nitrogen gas is also extracted from the vicinity of the top of the lower pressure rectifier 21, is supplied to the molecular sieve adsorption unit 11 and the evaporative cooling tower 5.

High-purity liquid oxygen, which will be recovered as a final oxygen gas product later, is produced in the bottom of the lower pressure rectifier 21. The liquid oxygen contains heavy impurities which are not removed in the purification step. The present invention is characterized by a step which produces gaseous oxygen having a desired supply pressure from the liquid oxygen containing the heavy impurities.

The liquid oxygen extracted from the bottom of the lower pressure rectifier 21 is compressed to a predetermined supply pressure by a liquid oxygen pump (compressing means) 27 and is supplied to the main heat exchanger 17 through a line 25. The liquid oxygen is evaporated by heat in an oxygen channel of the main heat exchanger 17 and the final oxygen gas product is recovered from a line 15. In this embodiment, the linear velocity of the gaseous oxygen in the oxygen channel is set to be higher than a terminal velocity of liquid oxygen droplet having a predetermined diameter, in which the terminal velocity is determined depending on the supply pressure.

Figure 2:
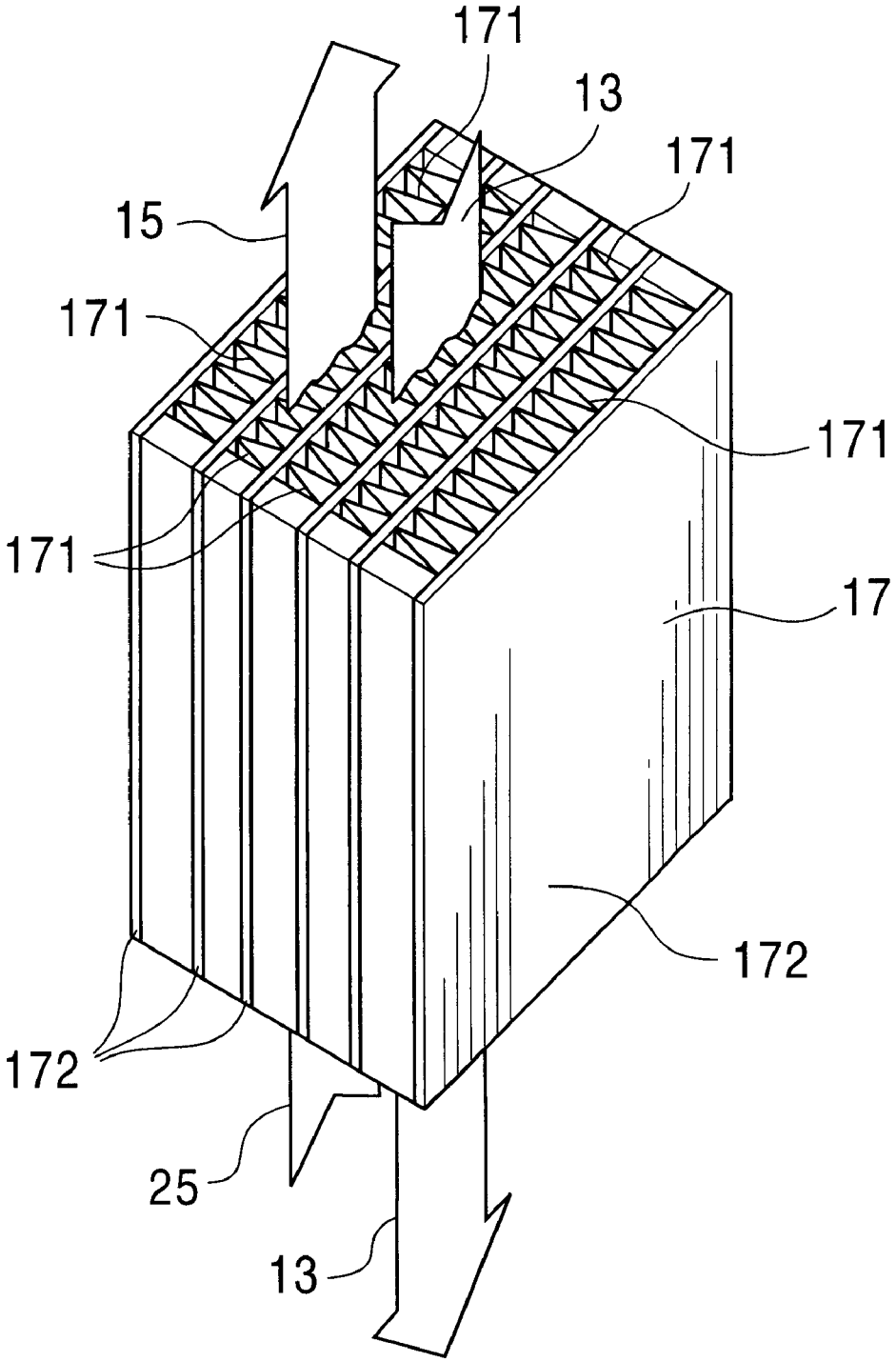
FIG. 2 is a perspective view of a heat exchanger.

FIG. 2 is an example of the main heat exchanger 17. The main heat exchanger 17 in FIG. 2 is a plate-fin heat exchanger having a conventional structure. That is, the main heat exchanger 17 has a plurality of barriers 172 and corrugated plate fins 171 interposed between the barriers 172. The main heat exchanger 17 includes the line 13 for the raw air to be liquefied and an oxygen channel including the line 25 for the liquid oxygen to be evaporated and the line 15 for the final oxygen gas product.

In order to control the linear velocity in the line 15 of the oxygen gas which is evaporated in the oxygen channel of the main heat exchanger 17 to the above-mentioned predetermined velocity or more, the cross-section of the oxygen channel to line 15 in the heat exchanger 17, the heat exchanger effectiveness in the main heat exchanger 17, and the flow rate of the supplied liquid oxygen are appropriately determined.

That is, when oxygen is evaporated under a pressure of 0.503 MPa in the main heat exchanger 17, the density of saturated liquid oxygen is 1,042 kg/m$^3$, the density of saturated gaseous oxygen is 19.8 kg/m$^3$, and the viscosity of the saturated gaseous oxygen is $9.02\times10^{-6}$ Pa·s (0.00000902 Pa·s) under such a pressure. Thus, the terminal velocity u of an oxygen droplet having a diameter of 200 $\mu$m is 0.430 m/s according to equation (1), the terminal velocity u of an oxygen droplet having a diameter of 500 $\mu$m is 0.874 m/s according to equation (2), and the terminal velocity u of an oxygen droplet having a diameter of 1 mm is 1.24 m/s according to equation (2). When the amount of the oxygen gas produced in the heat exchanger or exhausted from the outlet of the heat exchanger is 10 kg/s, the amount is converted to a density of the saturated gaseous oxygen of 0.505 m$^3$/s. Thus, when the cross-section of the oxygen channel in the heat exchanger is 1.17 m$^2$ or less, the oxygen gas can flow at a linear velocity which is equal to or higher than the terminal velocity 0.430 m/s of an oxygen droplet having a diameter of 200 $\mu$m. When the cross-section of the oxygen channel in the heat exchanger is 0.578 m$^2$ or less, the oxygen gas can flow at a linear velocity which is equal to or higher than the terminal velocity 0.874 m/s of an oxygen droplet having a diameter of 500 $\mu$m. When the cross-section of the oxygen channel in the heat exchanger is 0.407 m$^2$ or less, the oxygen gas can flow at a linear velocity which is equal to or higher than the terminal velocity 1.24 m/s of an oxygen droplet having a diameter of 1 mm.

EXAMPLES

Experiments under various conditions were performed on the linear velocity of the oxygen gas in the oxygen channel of the main heat exchanger 17 to prevent accumulation and deposition of heavy impurities.

Figure 3:
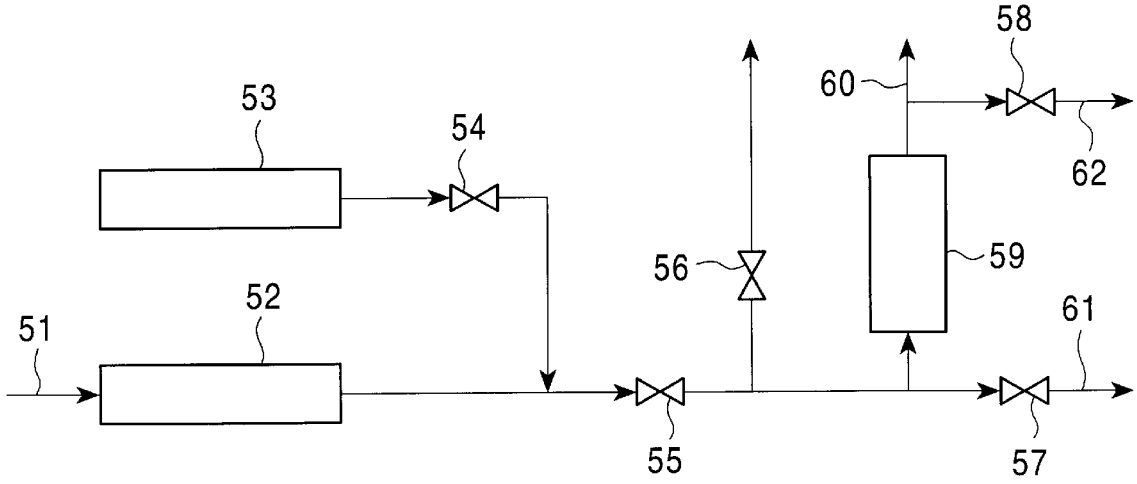
FIG. 3 is a schematic diagram of an experimental apparatus used in Examples of the present invention.

FIG. 3 is a schematic diagram of an apparatus for the experiments. A hydrocarbon gas 53 as a heavy impurity was added to liquid oxygen 51 which was compressed to a predetermined supply pressure by a pump 52, and the mixture was evaporated in an aluminum-fin heat exchanger 59. Liquid oxygen 61, which was not supplied to the aluminum-fin heat exchanger 59, and oxygen gas 62, which was exhausted from the aluminum-fin heat exchanger 59 were sampled, and the heavy-impurity concentrations in these samples were determined. In the drawing, numerals 54 to 58 represent valves.

Example 1

Production of oxygen gas using raw air containing typical amounts of heavy impurities was studied, as shown in Table 1. In general, the raw air is purified by adsorption in a molecular-sieve adsorbing unit prior to rectification. The heavy impurities show different removal rates in the adsorption process. The permeability of the heavy impurities and the heavy impurity concentrations in the raw air after the adsorption process are shown in Table 1. The purified raw air is rectified in the rectifier. In the rectifying process, the heavy impurities are dissolved in oxygen having a higher boiling point. Since the raw air contains approximately 20% of oxygen, the heavy impurities in the liquid oxygen are concentrated by approximately 5 times. Thus, the concentrated heavy impurities are dissolved in the liquid oxygen and are supplied to the heat exchanger. The heavy impurity concentrations are shown in the bottom column of Table 1.

TABLE 1

| | Methane | Ethane | Ethylene | Acetylene | Propane | Butane | Pentane |
|---|---|---|---|---|---|---|---|
| Concentration in Typical Raw Air | 3 ppm | 10 ppb | 20 ppb | 10 ppb | 20 ppb | 5 ppb | 5 ppb |
| Permeability in Adsorption Process | 100% | 100% | 100% | 5% | 25% | 10% | 10% |
| Concentration in Air after Adsorption Process | 3 ppm | 10 ppb | 20 ppb | 0.5 ppb | 5 ppb | 0.5 ppb | 0.5 ppb |
| Concentration in Liquid Oxygen | 15 ppm | 50 ppb | 100 ppb | 2.5 ppb | 25 ppb | 2.5 ppb | 2.5 ppb |

TABLE 2

| | | Terminal Velocity of 100-μm Oxygen Droplet | | | | | | |
|---|---|---|---|---|---|---|---|---|
| Pressure | Terminal Velocity | Methane | Ethane | Ethylene | Acetylene | Propane | Butane | Pentane |
| 0.3 MPa | 0.27 m/s | NP | NP | NP | NP | NP | P | P |
| 0.5 MPa | 0.22 m/s | NP | NP | NP | NP | NP | NP | P |
| 1 MPa | 0.16 m/s | NP | NP | NP | NP | NP | NP | P |
| 2 MPa | 0.10 m/s | NP | NP | NP | NP | NP | NP | NP |
| 4 MPa | 0.053 m/s | NP | NP | NP | NP | NP | NP | NP |

Note: NP indicates "Not precipitated" and P indicates "Precipitated".

TABLE 3

| | | Terminal Velocity of 200-μm Oxygen Droplet | | | | | | |
|---|---|---|---|---|---|---|---|---|
| Pressure | Terminal Velocity | Methane | Ethane | Ethylene | Acetylene | Propane | Butane | Pentane |
| 0.3 MPa | 0.51 m/s | NP | NP | NP | NP | NP | NP | NP |
| 0.5 MPa | 0.44 m/s | NP | NP | NP | NP | NP | NP | NP |
| 1 MPa | 0.31 m/s | NP | NP | NP | NP | NP | NP | NP |
| 2 MPa | 0.20 m/s | NP | NP | NP | NP | NP | NP | NP |
| 4 MPa | 0.10 m/s | NP | NP | NP | NP | NP | NP | NP |

Note: NP indicates "Not precipitated" and P indicates "Precipitated".

The liquid oxygen, which contained heavy impurities in amounts shown in the bottom line of Table 1, was prepared using the above apparatus. The liquid oxygen was evaporated in the heat exchanger to prepare gaseous oxygen and to observe whether or not the heavy impurities were accumulated and precipitated in the heat exchanger.

The experiments were performed at five pressure levels of 0.3 MPa, 0.5 MPa, 1 MPa, 2 MPa, and 4 MPa. The gaseous oxygen evaporated was circulated in the heat exchanger at a linear velocity which corresponded to the terminal velocity of an oxygen droplet having a diameter of 100 μm or 200 μm according to equation (1), and the concentration of the heavy impurities in the liquid oxygen supplied to the heat exchanger and the concentration in the gaseous oxygen exhausted from the heat exchanger were compared at each supply pressure. The experimental velocity is based on saturated gas density at the pressure.

Tables 2 and 3 show the results at 100 μm and 200 μm, respectively.

As shown in Table 2, when the gaseous oxygen is circulated in the heat exchanger at a linear velocity corresponding to the terminal velocity of the oxygen droplet having a diameter of 100 μm, butane and pentane are accumulated at a supply pressure of 1 MPa or less to a level higher than the solubility and are precipitated in the heat exchanger. It is considered that, at a low linear velocity of the gaseous oxygen in the heat exchanger, migration of heavy impurities by entrainment into the gas phase is insufficient. Thus, the migration of the heavy impurities substantially depends on the vapor pressures of the heavy impurities. As a result, evaporation of butane and pentane having low vapor pressures is not promoted.

In contrast, as shown in Table 3, when the gaseous oxygen is circulated in the heat exchanger at a linear velocity corresponding to the terminal velocity of the oxygen droplet having a diameter of 200 μm, the concentration of each heavy impurity in the liquid oxygen in the heat exchanger is maintained at a level which is lower than the solubility thereof to the liquid oxygen, and the concentration of each component in the gaseous oxygen exhausted from the heat exchanger reaches the concentration of the corresponding component in the liquid oxygen supplied into the heat exchanger. Thus, this is a steady state and these heavy impurities are not deposited in the heat exchanger.

It is considered that, at a sufficiently high linear velocity of the gaseous oxygen, migration of the heavy impurities into the gas phase is prompted by entrainment.

These experimental results show that accumulation and precipitation of heavy impurities in the heat exchanger can be prevented when the apparatus is operated at a linear velocity corresponding to the terminal velocity of the oxygen droplet having a diameter of 200 μm.

Example 2

Production of oxygen gas using raw air containing large amounts of heavy impurities was studied, as shown in Table 4. Such high amounts of heavy impurities are sometimes observed in industrial zones. The concentrations of the heavy impurities contained in the liquid oxygen separated from the raw air are calculated as in Example 1. The concentrations of the heavy impurities in the liquid oxygen supplied into the heat exchanger are shown in the bottom line of Table 4.

As shown in Table 4, as the concentrations of the heavy impurities increase in the raw air, the concentrations of the heavy impurities also increase in the liquid oxygen supplied into the heat exchanger and these heavy impurities tend to be deposited in the heat exchanger.

Liquid oxygen containing the heavy impurities having concentrations shown in the bottom line of Table 4 was produced using the above apparatus as in Example 1. The liquid oxygen was evaporated in the heat exchanger to prepare gaseous oxygen and to observe whether or not the heavy impurities were accumulated and precipitated in the heat exchanger.

The experiments were performed at five pressure levels of 0.3 MPa, 0.5 MPa, 1 MPa, 2 MPa, and 4 MPa. The gaseous oxygen evaporated was circulated in the heat exchanger at a linear velocity which corresponded to the terminal velocity of an oxygen droplet having a diameter of 200 $\mu$m according to equation (1), the terminal velocity of an oxygen droplet having a diameter of 500 $\mu$m according to equation (2), or the terminal velocity of an oxygen droplet having a diameter of 1 mm according to equation (21), and the concentration of the heavy impurities in the liquid oxygen supplied to the heat exchanger and the concentration in the gaseous oxygen exhausted from the heat exchanger were compared at each feed pressure.

Tables 5 to 7 show the results at 200 m, 500 m, and 1 mm, respectively.

TABLE 4

| | Methane | Ethane | Ethylene | Acetylene | Propane | Butane | Pentane |
|---|---|---|---|---|---|---|---|
| Concentration in Raw Air | 4 ppm | 20 ppb | 40 ppb | 20 ppb | 40 ppb | 20 ppb | 20 ppb |
| Permeability in Adsorption Process | 100% | 100% | 100% | 5% | 25% | 10% | 10% |
| Concentration in Air after Adsorption Process | 4 ppm | 20 ppb | 40 ppb | 1 ppb | 10 ppb | 2 ppb | 2 ppb |
| Concentration in Liquid Oxygen | 20 ppm | 100 ppb | 200 ppb | 5 ppb | 50 ppb | 10 ppb | 10 ppb |

TABLE 5

| Terminal Velocity of 200-$\mu$m Oxygen Droplet | | | | | | | | |
|---|---|---|---|---|---|---|---|---|
| Pressure | Terminal Velocity | Methane | Ethane | Ethylene | Acetylene | Propane | Butane | Pentane |
| 0.3 MPa | 0.51 m/s | NP | NP | NP | NP | NP | NP | P |
| 0.5 MPa | 0.44 m/s | NP | NP | NP | NP | NP | NP | P |
| 1 MPa | 0.31 m/s | NP | NP | NP | NP | NP | NP | P |
| 2 MPa | 0.20 m/s | NP | NP | NP | NP | NP | NP | P |
| 4 MPa | 0.10 m/s | NP | NP | NP | NP | NP | NP | NP |

Note: NP indicates "Not precipitated" and P indicates "Precipitated".

TABLE 6

| Terminal Velocity of 500-$\mu$m Oxygen Droplet | | | | | | | | |
|---|---|---|---|---|---|---|---|---|
| Pressure | Terminal Velocity | Methane | Ethane | Ethylene | Acetylene | Propane | Butane | Pentane |
| 0.3 MPa | 1.1 m/s | NP | NP | NP | NP | NP | NP | P |
| 0.5 MPa | 0.87 m/s | NP | NP | NP | NP | NP | NP | NP |
| 1 MPa | 0.60 m/s | NP | NP | NP | NP | NP | NP | NP |
| 2 MPa | 0.39 m/s | NP | NP | NP | NP | NP | NP | NP |
| 4 MPa | 0.20 m/s | NP | NP | NP | NP | NP | NP | NP |

Note: NP indicates "Not precipitated" and P indicates "Precipitated".

TABLE 7

| Terminal Velocity of 1-mm Oxygen Droplet | | | | | | | | |
|---|---|---|---|---|---|---|---|---|
| Pressure | Terminal Velocity | Methane | Ethane | Ethylene | Acetylene | Propane | Butane | Pentane |
| 0.3 MPa | 1.6 m/s | NP | NP | NP | NP | NP | NP | NP |
| 0.5 MPa | 1.2 m/s | NP | NP | NP | NP | NP | NP | NP |
| 1 MPa | 0.84 m/s | NP | NP | NP | NP | NP | NP | NP |
| 2 MPa | 0.55 m/s | NP | NP | NP | NP | NP | NP | NP |
| 4 MPa | 0.28 m/s | NP | NP | NP | NP | NP | NP | NP |

Note: NP indicates "Not precipitated" and P indicates "Precipitated".

As shown in Table 5, when the gaseous oxygen is circulated in the heat exchanger at a linear velocity corresponding to the terminal velocity of the oxygen droplet having a diameter of 200 $\mu$m, pentane is accumulated at a supply pressure of 2 MPa or less to a level higher than the solubility and is precipitated in the heat exchanger. It is considered that, at a low linear velocity of the gaseous oxygen in the heat exchanger, migration of heavy impurities by entrainment into the gas phase is insufficient. Thus, the migration of the heavy impurities substantially depends on the vapor pressures of the heavy impurities. As a result, evaporation of pentane having a low vapor pressure is not promoted.

In contrast, as shown in Table 6, when the gaseous oxygen is circulated in the heat exchanger at a linear velocity corresponding to the terminal velocity of the oxygen droplet having a diameter of 500 $\mu$m, the heavy impurities are not precipitated, except for pentane, which is precipitated at a supply pressure of 0.3 MPa.

Moreover, as shown in Table 7, when the gaseous oxygen is circulated in the heat exchanger at a linear velocity corresponding to the terminal velocity of the oxygen droplet having a diameter of 1 mm, the concentration of each heavy impurity in the liquid oxygen in the heat exchanger is maintained at a level which is lower than the solubility thereof to the liquid oxygen, and the concentration of each component in the gaseous oxygen exhausted from the heat exchanger reaches the concentration of the corresponding component in the liquid oxygen supplied into the heat exchanger. Thus, this is a steady state and these heavy impurities are not deposited in the heat exchanger.

It is considered that, at a sufficiently high linear velocity of the gaseous oxygen, migration of the heavy impurities into the gas phase is prompted by entrainment.

These experimental results show that accumulation and precipitation of heavy impurities in the heat exchanger can be prevented when the apparatus is operated at a linear velocity corresponding to the terminal velocity of the oxygen droplet having a diameter of 500 $\mu$m, and more preferably 1 mm.

The following embodiments are also preferably employed in the present invention.

A. The present invention is applicable to any known production plants for producing oxygen gas from liquid oxygen which is separated by a rectifier, in addition to the above-described plant.

B. The present invention is applicable to any known heat exchangers, in addition to the above-described plate-fin heat exchanger.

What is claimed is:

1. A method for producing gaseous oxygen from raw air comprising the steps of:

compressing the raw air to a first predetermined supply pressure;

distilling liquid oxygen from the raw air;

compressing the liquid oxygen to a second predetermined supply pressure;

supplying the compressed liquid oxygen to a heat exchanger under the second predetermined supply pressure; and evaporating and gasifying the compressed liquid oxygen in the heat exchanger so that a plurality of liquid oxygen droplets are formed due to irregularities on the surface of the liquid oxygen or the interface between the liquid oxygen and the gaseous oxygen, and thereby heavy impurities contained in the liquid oxygen droplets are evaporated with the liquid oxygen droplets entrained in the gaseous oxygen flow;

wherein the gaseous oxygen flows upwards in the heat exchanger at a linear velocity which is equal to or higher than the terminal velocity u of each of the liquid oxygen droplets having a diameter of 200 $\mu$m calculated by equation (1):

$$u = \left( \frac{4g^2(\rho_L - \rho_G)^2 D_P^3}{225\,\mu p_G} \right)^{1/3}$$

wherein u: terminal velocity of liquid oxygen droplets, g: the acceleration due to gravity, $\rho_L$: density of saturated liquid oxygen at the supply pressure, $\rho_G$: density of saturated gaseous oxygen at the supply pressure, $\mu$: viscosity of saturated gaseous oxygen at the supply pressure, and $D_P$: diameter of the liquid oxygen droplet.

2. A method for producing gaseous oxygen from raw air comprising the steps of:

compressing the raw air to a first predetermined supply pressure;

distilling liquid oxygen from the raw air;

compressing the liquid oxygen to a second predetermined supply pressure;

supplying the compressed liquid oxygen to a heat exchanger under the second predetermined supply pressure; and evaporating and gasifying the compressed liquid oxygen in the heat exchanger so that a plurality of liquid oxygen droplets are formed due to irregularities on the surface of the liquid oxygen or the interface between the liquid oxygen and the gaseous oxygen, and thereby heavy impurities contained in the liquid oxygen droplets are evaporated with the liquid oxygen droplets entrained in the gaseous oxygen flow;

wherein the gaseous oxygen flows upwards in the heat exchanger at a linear velocity which is equal to or higher than the terminal velocity u of each of said plurality of liquid oxygen droplets having a diameter of 500 $\mu$m calculated by equation (2):

$$u = \left( \frac{3.03g(\rho_L - \rho_G)D_P}{\rho_G} \right)^{1/2} \quad (2)$$

wherein u: terminal velocity of liquid oxygen droplets, g: acceleration due to gravity, $\rho_L$: density of saturated liquid oxygen at the supply pressure $\rho_G$: density of saturated gaseous oxygen at the supply pressure, and $D_P$: diameter of the liquid oxygen droplet.

3. A method for producing gaseous oxygen according to claim 2, wherein each of the liquid oxygen droplets has a diameter of 1 mm.

* * * * *